United States Patent [19]

Selzer et al.

[11] Patent Number: 4,651,688

[45] Date of Patent: Mar. 24, 1987

[54] MODEL AIRPLANE ENGINE STARTER AND DRIVE TRAIN

[75] Inventors: William H. Selzer, Santa Ana; J. Dale Kirn, Anaheim, both of Calif.

[73] Assignee: Cox Hobbies, Inc., Santa Ana, Calif.

[21] Appl. No.: 845,527

[22] Filed: Mar. 28, 1986

[51] Int. Cl.[4] ..... F02N 5/02

[52] U.S. Cl. ..... 123/185 D; 123/179 S; 185/41 A

[58] Field of Search ..... 123/185 D, 185 R, 179 S, 123/179 AS, 179 SE; 185/41 A, 41 R, 39

[56] References Cited

U.S. PATENT DOCUMENTS

| | | | |
|---|---|---|---|
| 3,102,523 | 9/1963 | Frisbie | 123/185 D |
| 3,131,682 | 5/1964 | Garofalo | 123/185 D |
| 3,159,154 | 12/1964 | Garofalo | 123/185 D |
| 4,440,122 | 4/1984 | Theobald | 123/185 D |

*Primary Examiner*—Andrew M. Dolinar

*Attorney, Agent, or Firm*—Schroeder & Siegfried

[57] ABSTRACT

A model internal-combustion engine having a rotatable shaft driven by an engine, a propeller secured to said shaft, and a combined self-starting mechanism and propeller drive in the form of a plastic cylindrical connector mounted coaxially on the shaft with one end thereof in driving relation against the propeller, the connector including a metal hub imbedded therein, the hub being fixedly mounted on said shaft for driven rotation therewith and having a knurled end thereof bearing against said propeller to drive the same, the connector having ramp-defining walls adjacent a spring-engaging element at one of its ends, and a helically wound spring surrounding the shaft, anchored at one end to a stationary part of the engine and having a free end bearing against the ramp-defining walls of the connector with a hook formed thereon to automatically engage the spring-engaging element of the connector and thereby energize the spring when the propeller and connector are rotated in a contra-normal direction and to otherwise ride on the ramps of the connector in non-engaging relation to its spring engaging element. A drive element extending axially outwardly from the end of the connector in position to drive the propeller, if needed, may or may not be included.

8 Claims, 6 Drawing Figures

MODEL AIRPLANE ENGINE STARTER AND DRIVE TRAIN

BACKGROUND OF PRIOR ART

The closest prior art is believed to be U.S. Pat. No. 4,440,122, issued to Roger D. Theobald, on Apr. 3, 1984, and entitled "Model Airplane Engine Starter". The contents thereof is incorporated herein by reference thereto. Particular reference is made to the prior art discussion contained therein, in Column 1 thereof and to the structure disclosed and claimed therein.

The device shown in the above Theobald patent constitutes a definite contribution to the art in that it positively precludes running of the engine in reverse, and in that the starter spring automatically engages the propeller and becomes energized when the latter is rotated in a contra-normal direction. Extended usage thereof has shown, however, that the connector member which connects the drive shaft to the propeller tends, upon occasion, to become loose and to slip, with the result that although the engine continues to operate properly, the propeller is no longer adequately driven because the connector member slips relative to the drive plate carried by the drive shaft. When the engine is shut off or runs out of fuel, the rapidly rotating propeller tends to continue to rotate. Since this tendency is directed in a direction opposite to that in which the propeller-securing nut tightens, the nut is urged by the propeller to turn toward a loosened position, causing the propeller to be held in a less-secured relation against the drive plate. As a consequence, power is lost initially and finally, the propeller may not be driven at all.

BRIEF SUMMARY OF THE INVENTION

The invention provides a positive guarantee against the problem described hereinabove in that there is no way that the propeller can slip relative to its driving member as a result of slight loosening of the nut which secures the propeller to the drive shaft. This is accomplished by ensuring positively against any slippage between the propeller and its associated driving member. Toward this end, we have embedded a metal hub within the center of the otherwise plastic connector which provides the advantages referred to hereinabove in the above Theobald patent. This metal hub is press-fit upon an end of the drive shaft which is splined to preclude slippage between the shaft and hub. The hub is provided with a hexagonal circumferential surface to preclude relative rotation between the connector and its hub. The outer end of the hub terminates abreast of the outer end of the rest of the connector and is knurled to positively drive the propeller which it engages and against which it is secured by the threaded propeller-securing pin which is threaded into the end of the drive shaft. As added insurance, the connector carries an outwardly extending fixed and rigid drive element in position to engage the propeller and to drive the same, if and when it is so engaged.

BRIEF DESCRIPTION OF THE DRAWINGS

A detailed description of one preferred embodiment of the MODEL AIRPLANE ENGINE STARTER AND DRIVE TRAIN is hereafter described with specific reference being made to the drawings in which.

DETAILED DESCRIPTION OF THE INVENTION

Figure 1:
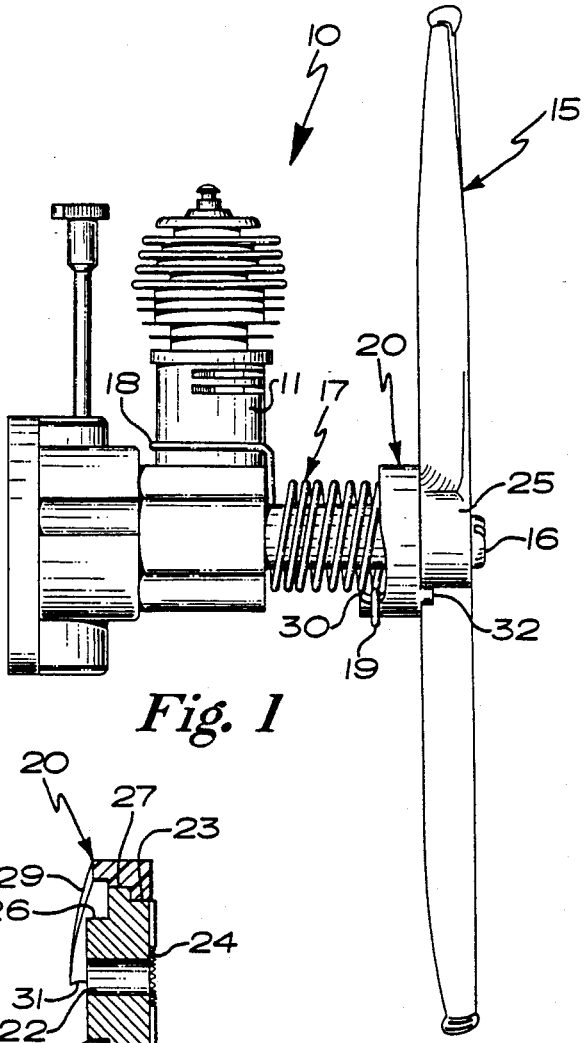
FIG. 1 is a left side elevational view of a self-starting model internal-combustion engine embodying my invention.
Figure 3:
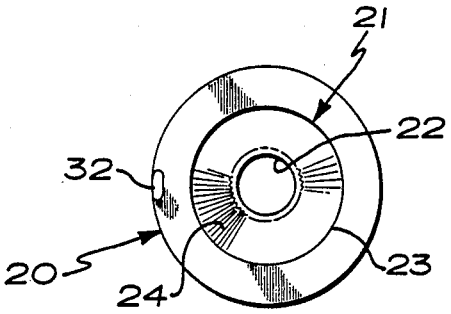
FIG. 3 is an outer end elevational view of the connector member.
Figure 4:
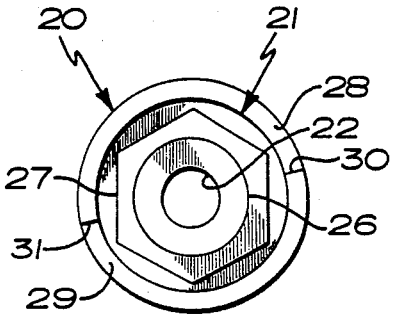
FIG. 4 is an inner end elevational view of the connector member.
Figure 2:
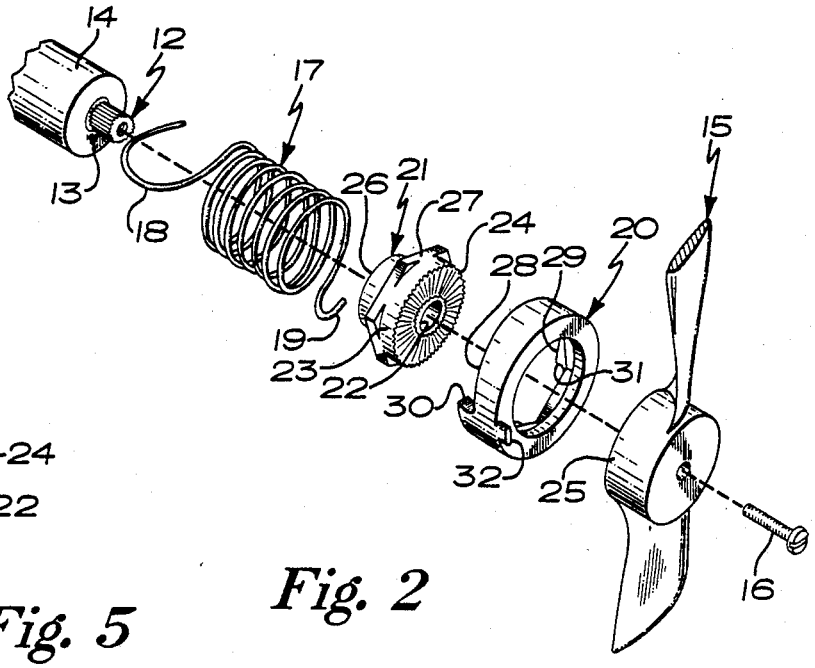
FIG. 2 is an exploded perspective view of the propeller and self-starter assembly elements, with the more remote parts of the propeller and engine shaft journal broken away.

One embodiment of our invention, as shown in FIGS. 1–6, inclusive, may include a conventional model internal-combustion engine 10 which includes a cylinder 11, a drive shaft 12, the outer end 13 of which is splined, as shown in FIG. 2. The shaft 12 is carried in its tubular journal 14. The engine also includes a propeller 15 and a machine screw 16 which secures the propeller to the drive shaft and is threaded into the internally threaded counter-bore in the outer end of the shaft 12.

As shown, the self-starter includes a helically wound wire spring 17 made of wire as described in U.S. Pat. No. 2,751,898. This spring has its inner end formed into a loop or anchor element 18 which extends around the cylinder 11 to anchor the spring thereto. The other end of the spring 17 is formed into a hook member 19 which extends radially outwardly in a radial plane from the outer end convolution. The anchor element 18 extends axially outwardly from the opposite end of the spring in a plane tangential to the convolutions of the spring.

As shown in FIGS. 1 and 2, the spring 17 is mounted in coaxial surrounding relation to the drive shaft 12 and is tubular journal 14. One of its ends bears against the end of the crankcase of the engine 10 and at its opposite end against a cylindrically-shaped plastic connector member 20.

Figure 5:
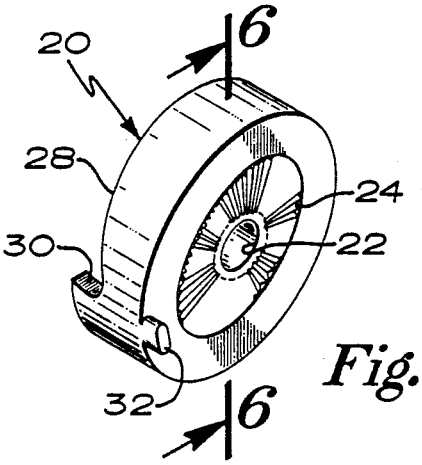
FIG. 5 is a perspective view of the metal hub of the connector member.

The plastic connector member 20 has a metal hub element 21 embedded therein which is fixedly mounted at its axis on the splined end 13 of shaft 12 for driven rotation therewith. As best shown in FIG. 5, the hub element 21 has a central bore 22. The outer end portion 23 of the hub element is cylindrical in configuration and its outer end surface is knurled as at 24. The diameter of this end portion 23 is equal to the diameter of the hub 25 of the propeller 15 and bears thereagainst to rotatively drive the same when the self-starter is properly assembled.

The inner end portion 26 of the hub element is also cylindrical in configuration and is of reduced diameter as compared to the outer end 23 and bears against the outer end of the journal 14 when assembled. The intermediate portion 27 of the hub element 21 is hexagonal in configuration and keys the hub element to the innermore plastic portion of the connector member 20, since it is embedded therein.

Since the hub element 21 is embedded in the innermore plastic portion of the connector element 20, the inner end of the plastic portion has a hexagonally-shaped recess therein in which the correspondingly shaped intermediate hub portion 27 lies. Peripheral walls 28 and 29 extend circumferentially and axially inwardly from the areas of the connector surrounding the intermediate portion 27 of the metal hub, defining ramps which terminate abruptly at spring-engaging elements or tangs 30 and 31. It will be seen by reference to FIGS. 1 and 2 that peripheral walls 28 and 29 each slope axially outwardly away from the propeller until they reach the next spring-engaging element 30 or 31, at which point the next inward cut is made to form the next spring-engaging element.

Figure 6:
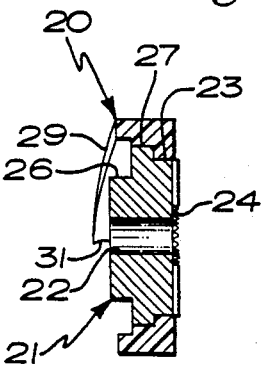
FIG. 6 is a vertical sectional view of a modified connector member without the propeller driving element thereon, viewed from a position such as along line 6—6 of FIG. 5.

The diametrical dimensions of the recess of the connector member 20 defined by the peripheral walls 28 and 29 are slightly larger than the external diameter of the spring 17 so that the end of the latter which carries the hook 19 extends into that recess. As a consequence, the hook 19 rides upon the ramps 28 and 29 at all times as the propeller and connector member rotate while free running, and snaps into the recess adjacent the spring-engaging element each time that point passes the hook, and thereafter is gradually cammed axially away from the propeller until the next spring-engaging element 30 or 31 passes. At the opposite end of the connector member 20, a drive element 32 extends axially outwardly from the periphery thereof. In a second form of the invention, as shown in FIG. 6, this drive element 32 may not be included.

As stated hereinbefore, the machine screw 16 secures the propeller 15 to the engine, passing through the axial opening of the propeller, the central bore 22 of the hub element 21, and extending into the threaded counterbore of the shaft 12. When tightened, the machine screw 16 forces the hub of propeller 15 against the knurled end surface 23 of the hub 21 and holds the two against relative rotation. Since the latter is keyed to the shaft 12 by the splined end thereof, it is impossible for relative rotation to occur therebetween.

The drive element 32 is positioned so as to engage the propeller blades and thereby drive the propeller when so engaged. Since it extends axially beyond the propeller blade, there is no way slippage can occur between the drive shaft 12 and the propeller 15.

Although there is a slight drag created by the hook member 19 riding along the ramps 28, 29, the drag and the attendant wear upon the ramps is not appreciable because the latter are formed of plastic which has self-lubricating qualities. Thus, it does not materially affect the operation or performance of the engine 10 and does not cause undue wear upon either the portion of the spring which rides upon the ramp or upon the ramp walls themselves. The plastic material from which the connector member 20 is made is sold commercially under the trademark ZYTEL Nylon by Dupont de Nemours E I & Co., of Wilmington, Del.

The self-starter assembly described herein is operated to effect starting in the same manner as described in U.S. Pat. No. 4,440,122, and the spring member rides upon the ramps when the engine is running in the same manner as described therein.

From the above, it can be seen that we have provided a self-starter for a model internal-combustion engine which is so constructed and arranged as to make it impossible for slippage of the propeller, and consequently failure of the system to properly function, to occur. We have retained the previously known advantages of the plastic connector, but have eliminated the undesirable aspects thereof, as hereinbefore described. The structure described hereinabove positively precludes propeller slippage and provides a reliable, consistent and inexpensive drive train for the propeller.

In considering this invention, it should be remembered that the present disclosure is illustrative only and the scope of the invention should be determined by the appended claims.

We claim:

1. A self-starter for a model internal combustion engine of the type having a source of power, a rotatable shaft operated by said source, and a propeller secured to said shaft, said starter comprising:

(a) a coiled spring for mounting over said shaft in surrounding relation; and (b) a connector constructed and arranged to be carried by said shaft in interconnecting driving relation between said spring and the propeller and between the shaft and the propeller;

(c) said connector being made of a plastic material and including a metal hub imbedded therein in fixed non-rotative relation thereto;

(d) said hub being constructed and arranged to be fixedly mounted on said shaft for rotation therewith;

(e) said connector having opposite ends and having a spring-engaging element at one of its ends constructed and arranged to be automatically engaged by said spring in biased relation whenever said connector is rotated in contra-normal relation by the propeller and having propeller-driving means at its opposite end;

(f) said spring having a stationary end formed for attachment to the engine and having a free end formed for attachment to said connector, said free-end being constructed and arranged to engage said spring-engaging element in biasing relation when said connector is rotated in a contra-normal direction and to bear against and ride upon one end of said connector in non-engaging relation to said element when said connector is rotated by the propeller in a normal direction.

2. The structure defined in claim 1, wherein said propeller driving means includes an axially extending drive element extending between said propeller and said connector in driving relation to said propeller.

3. The structure defined in claim 1 wherein said propeller-driving means is comprised of a drive element extending axially outwardly from said connector toward said propeller in position to engage and drive the same as said connector and hub rotate with the shaft.

4. The structure defined in claim 1 wherein said propeller-driving means is comprised of knurling formed on the end of said hub and engaging the propeller in driving relation.

5. A model internal-combustion engine having a rotatable shaft driven by said engine;

(a) a propeller secured to said shaft in driven relation for rotation thereof by said shaft; and (b) a combined drive for said propeller and starting mechanism for said engine, said combined mechanism and drive including;

(1) a spring member having one end anchored in fixed position to a stationary part of said engine, and the other end of said spring member being contantly positioned in automatically drivable relation with said propeller upon rotation of said propeller in contra-normal direction whereby said spring member automatically will become energized upon rotation of said propeller in a contra-normal direction and, upon subsequent release of said propeller, will drive the same in its normal direction until de-energized;

(2) a plastic connector mounted on said shaft for rotation therewith and being disposed between said propeller and said other end of said spring member and connecting the same in interconnected driving relation and having a spring-engaging element thereon;

(3) said connector including a metal hub element fixedly imbedded therein and mounted directly upon said shaft in fixed relation thereto for rotation therewith;

(4) said connector being connected in driving relation with said propeller and having an arcuate ramp surface extending in an axial direction away from the point of driving connection of said connector with said spring member contra to the normal direction of said propeller and away from said propeller and against which said other end of said spring member rides by means of which said propeller may rotate in its normal direction without energizing said spring member;

(5) said spring member being helically wound and having a free end formed into a hook member which extends radially outwardly and engages said spring-engaging element of said hub when the latter is rotated in a contra-normal direction with said propeller.

6. The structure defined in claim 5 and a drive element extending axially between said connector and said propeller in driving relation with the latter.

7. The structure defined in claim 5 wherein said hub element has a knurled end engaging said propeller in driving rotation thereto.

8. The structure defined in claim 5 and a drive element carried by said connector and extending axially therefrom in driving relation to said propeller.

* * * * *

UNITED STATES PATENT AND TRADEMARK OFFICE

CERTIFICATE OF CORRECTION

PATENT NO. : 4,651,688

DATED : March 24, 1987

INVENTOR(S) : William H. Selzer and J. Dale Kirn

It is certified that error appears in the above-identified patent and that said Letters Patent is hereby corrected as shown below:

Column 2, line 42, "is" should read "its"

Signed and Sealed this

Twenty-fourth Day of January, 1989

*Attest:*

DONALD J. QUIGG

*Attesting Officer*

*Commissioner of Patents and Trademarks*